US009101948B2

(12) United States Patent
Baron et al.

(10) Patent No.: US 9,101,948 B2
(45) Date of Patent: Aug. 11, 2015

(54) DISPENSING SUPPORT FOR GABLE TOP PACKAGING

(71) Applicant: NESTEC S.A., Vevey (CH)

(72) Inventors: Richard Baron, Zephyrhills, FL (US); Steve Robbins, Land O'Lakes, FL (US)

(73) Assignee: Nestec S.A., Vevey (CH)

( * ) Notice: Subject to any disclaimer, the term of this patent is extended or adjusted under 35 U.S.C. 154(b) by 60 days.

(21) Appl. No.: 13/926,620

(22) Filed: Jun. 25, 2013

(65) Prior Publication Data

US 2014/0014690 A1 Jan. 16, 2014

Related U.S. Application Data

(60) Provisional application No. 61/665,698, filed on Jun. 28, 2012.

(51) Int. Cl.

| | |
|---|---|
| ***B67D 7/06*** | (2010.01) |
| ***B05B 15/06*** | (2006.01) |
| ***B05B 11/00*** | (2006.01) |
| ***B65D 83/38*** | (2006.01) |

(52) U.S. Cl.

CPC ..... *B05B 15/06* (2013.01); *B05B 11/0037* (2013.01); *B05B 11/3045* (2013.01); *B65D 83/38* (2013.01); *Y10T 29/49826* (2015.01)

(58) Field of Classification Search

CPC ..... A47G 23/0258; B05B 11/0054; B05B 11/0037; B05B 11/3047; B05B 11/30; B05B 15/06; B05B 15/061; B65D 5/0085; B65D 61/00; B65D 85/16; B65D 85/54; B65D 85/72; B65D 85/80; B65D 77/04; B65D 77/0413; B65D 77/042; B65D 77/0446; B65D 77/0453

USPC ..... 222/183, 321.7, 383.1

See application file for complete search history.

(56) References Cited

U.S. PATENT DOCUMENTS

| | | | | | |
|---|---|---|---|---|---|
| 3,721,370 | A * | 3/1973 | Blum | 222/385 |
| 5,156,299 | A * | 10/1992 | De Caluwe et al. | 222/82 |
| 5,474,212 | A * | 12/1995 | Ichikawa et al. | 222/105 |
| 6,142,344 | A * | 11/2000 | Kai | 222/183 |
| 6,412,663 | B1 * | 7/2002 | Adamson et al. | 222/183 |
| 6,510,965 | B1 * | 1/2003 | Decottignies et al. | 222/95 |
| 6,604,655 | B1 * | 8/2003 | Lee | 222/135 |
| 2003/0141317 | A1 * | 7/2003 | Vance | 222/183 |
| 2005/0218159 | A1 * | 10/2005 | Hoour | 222/321.7 |
| 2011/0036846 | A1 * | 2/2011 | Corbett et al. | 220/495.03 |
| 2011/0220682 | A1 * | 9/2011 | Lim | 222/183 |
| 2014/0252032 | A1 * | 9/2014 | Corbett et al. | 222/105 |

* cited by examiner

*Primary Examiner* — Patrick M Buechner

(74) *Attorney, Agent, or Firm* — K&L Gates LLP

(57) ABSTRACT

Dispensing support for use with an associated brick-type package, the brick-type package presenting a parallelepiped shape for its bottom and side panels and a gable top panel with a pour spout attached thereto. The dispensing support comprises a parallelepiped sleeve, the sleeve being divided in two parts attached together by a hinge, so that the sleeve can be opened and the associated brick-type package can be inserted inside. The dispensing support presents an upwardly projecting spout extending from the top wall of the parallelepiped sleeve, the spout being off-center on the top wall of the sleeve so as to engage the pour spout at the gable top panel of the brick-type package when the package is introduced in the dispensing support with its gable top compressed.

6 Claims, 2 Drawing Sheets

DISPENSING SUPPORT FOR GABLE TOP PACKAGING

PRIORITY CLAIM

This application claims the benefit of U.S. Provisional Patent Application Ser. No. 61/665,698 filed on Jun. 28, 2012, the entire disclosure of which is hereby incorporated by reference.

BACKGROUND

The present invention is directed to a sleeve or support for a brick-type package and a dispenser for the contents of the package.

Brick-type packages are well-known in the art. These brick-type packages have four upstanding sidewalls, a flat bottom and a flat or gable top.

Many of the brick-type packages are used in food service establishments for storing beverages or beverage concentrates. As such, dispensing the product can be problematic. It is not desirable to leave the open package dispensing location: it is not hygienic and can result in contamination of the product.

Then it has been proposed to equip this kind of brick-type packages with a manual pump dispenser that is fitted in the top pour spout of the package. This pump is usually disposable so that when the package is empty the pump and the package can be thrown away. While such an arrangement may serve to improve hygiene and also the consistency for dosing the liquid stored in the package, it has been found difficult to press the pump due to the relative flexibility of the brick-type package. Actually although brick-type packages are somewhat rigid, they are typically made of a laminate having a paperboard core. Then pressure exercised on the pump and indirectly on the package can result in compressed or crushed walls.

U.S. Pat. No. 6,662,892 has proposed a solution to this problem consisting in a dispensing support that provides structural support in a dispenser for use with an associated brick-type package. The dispensing support includes a sleeve having at least three contiguous walls including at least one side wall and a top wall. The at least one side wall is configured to extend along the length of the one of the package side panels. The top wall has an opening therein configured to lie along the package top. The sleeve includes a locking element extending from one of the walls at a free end thereof. The locking element is configured to engage one of the package panels to secure the package within the sleeve. A pump dispenser extends through the top wall opening and is configured for insertion into the package. The package is fitted into and retained within the sleeve and the dispenser operates to dispense product from the package. An upwardly projecting spout can extend from the top wall opening. The spout can include threads formed thereon to threadedly engage the pump dispenser.

The prior art only provides a solution for brick-type packages presenting a flat top. But many brick-type packages present a gable top and cannot be used with a manual pump dispenser because once the pump dispenser is fitted in the pour spout it is not vertically oriented and then does not enable the normal correct handling of the pump.

Accordingly, there exists a need for providing brick-type packages presenting a gable top with a pump dispenser that can be vertically oriented and then correctly handled.

SUMMARY

The invention concerns dispensing supports providing a structural support for use with an associated brick-type package presenting a gable top. The brick-type package has a parallelepiped shape as for bottom and side panels and a gable top panel.

According to a first embodiment the dispensing support includes a parallelepiped sleeve each side wall of the sleeve being configured to extend along the length of each package side panels. The dispensing support is divided in two parts attached together by a hinge, so that the dispensing support can be opened and the associated brick-type package can be inserted inside. Preferably the hinge is placed at one of the vertical side corner of the parallepiped sleeve. The dispensing support usually comprises a locking element like a snap lock at the edges of the two parts of the dispensing support.

The dispensing support presents an upwardly projecting spout extending from the top wall. The spout can include threads formed thereon to threadedly engage a dispenser. The spout is off-centre on the top wall so as to face the pour spout of the gable top packaging when it is introduced in the support. Preferably the dispensing support is divided in two parts each of them comprising a part of the upwardly projecting spout. Consequently it is easier to introduce the packaging in the support. As previously mentioned a dispenser can extend through the top wall opening and is configured for insertion into the package. The package is fitted into and retained within the support and the dispenser operates to dispense product from the package.

The side walls of the support can include openings formed therein. This can be configured in conjunction with indicia or graphics on the package to permit the use of openings for product package markings and the like (e.g., marketing and advertising).

A gable top package can be introduced in the opened dispensing support by folding the gable top and maintaining the latter folded while the package is slid in the dispensing support. Then the opened dispensing support is closed by bringing back the two parts of the dispensing support one to the other and the two parts are locked together. Finally the pump dispenser can be introduced in the pour spout of the packaging and threaded on the upwardly projecting spout of the support.

According to a second embodiment the dispensing support includes a sleeve having at least five contiguous walls including at least three side walls, a bottom wall and a top wall. These walls define an internal parallepiped volume. The side walls are configured to extend along the length of the brick-type package side panels. The top wall presents a slit extending from the top wall edge that has no contiguous side wall. This slit is off-centre on the top wall so as to face the pour spout of the gable top packaging when it is introduced in the support.

The dispensing support presents an upwardly projecting partial spout extending from the top wall. The spout cooperates with the end of the slit on the top wall. The spout can include threads formed thereon to threadedly engage with a dispenser that can extend through the top wall and is configured for insertion into the package. The package is fitted into and retained within the support and the dispenser operates to dispense product from the package.

The side walls of the support can include openings formed therein. This can be configured in conjunction with indicia or graphics on the package to permit the use of openings for product package markings and the like (e.g., marketing and advertising).

A gable top package can be introduced in the opened dispensing support by folding the gable top and maintaining the latter folded while the package is slid in the dispensing support, the packaging pour spout being slid in the slit on the support top wall. Then the dispenser can be introduced in the pour spout of the packaging and threaded on the upwardly projecting spout of the support.

Additional features and advantages are described herein, and will be apparent from the following Detailed Description and the figures.

BRIEF DESCRIPTION OF THE FIGURES

The characteristics and advantages of the invention will be better understood in relation to the following figures.

DETAILED DESCRIPTION

Figure 1:
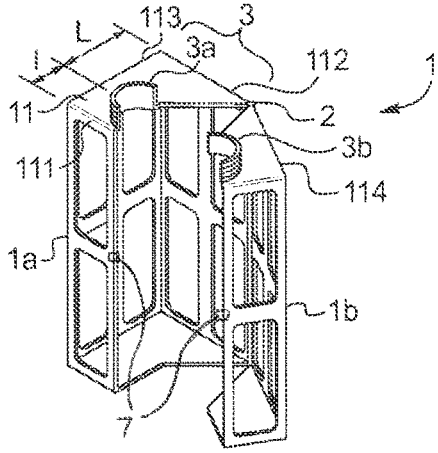
FIG. 1 shows a view of the dispensing support according to the first embodiment.

FIG. 1 illustrates a dispensing support 1 according to the first embodiment of the invention. It comprises a parallepiped sleeve, said sleeve being divided in two parts 1*a*, 1*b* attached together by a hinge 2, so that the sleeve can be opened as illustrated in FIG. 1. Dispensing support 1 may further include a locking element 7 (e.g., a snap lock) to maintain the dispensing support in a closed position. When closed the dispensing support presents an upwardly projecting spout 3 extending from the top wall 11 of the parallepiped sleeve. Each of the two parts 11*a*, 11*b* of the sleeve comprises a half part 3*a*, 3*b* of the upwardly projecting spout. When the sleeve 11 is closed the spout 3 is formed and is positioned off-centre on the top wall of the sleeve: in FIG. 1 the spout 3 is positioned closer to the side panel 111 of the sleeve (by the distance 1) rather than to the side panel 112 of the sleeve (by the distance L). In the other perpendicular direction the spout is centred between the two other side panels 113, 114 of the sleeve. Preferably each half part 3*a*, 3*b* of the upwardly projecting spout are threaded externally and presents threads that fit together.

Figure 1A:
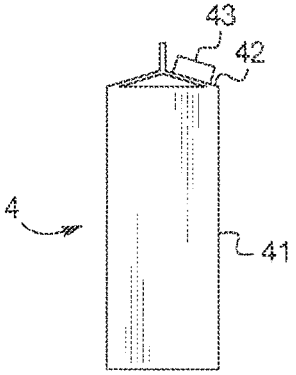
FIG. 1*a* is a drawing of a typical gable top packaging.

FIG. 1*a* illustrates a brick-type package 4 presenting a parallelepiped shape as for bottom and side panels 41 and a gable top panel 42 with a pour spout 43 attached thereto.

Figure 2:
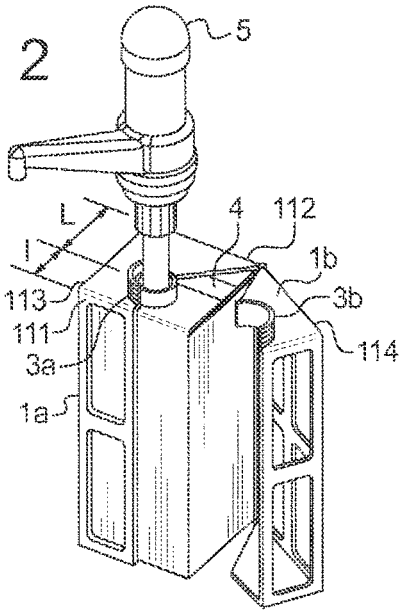
FIG. 2 shows how a package is introduced in the dispensing support of FIG. 1.
Figure 3:
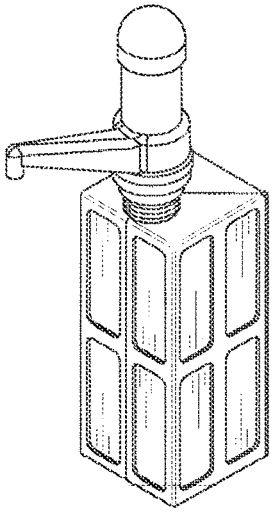
FIG. 3 shows a view of the dispensing support of FIG. 1 associated to a package.

As illustrated in FIG. 2 this package 4 can be inserted inside the dispensing support 1 by applying a compression on the gable top panel 42 so as to fold it until it is the top panel 42 is flat. Then the package 42 is introduced in one part 1*a* of the sleeve while maintaining the top folded and the package pour spout 43 fits inside one half part of the upwardly projecting spout 3 of the dispensing support 1. Then the dispensing support 1 can be closed by attaching the two parts 11*a*, 11*b* together; the second part of the half part of the upwardly projecting spout 3 of the dispensing support 1 cooperates with the package pour spout 43 and forms an upwardly projecting spout 3 with the first part that surrounds the package pour spout 43. A manual pumping dispenser 5 can be introduced in the pour spout 43 of the package and can be engaged with the upwardly projecting spout 3 of the dispensing support. FIG. 3 illustrates the assembly of the dispensing support 1, the package 4 and the dispenser 5, said assembly being ready to be operated for dispensing doses a liquid stored in the package in a convenient manner.

Figure 4:
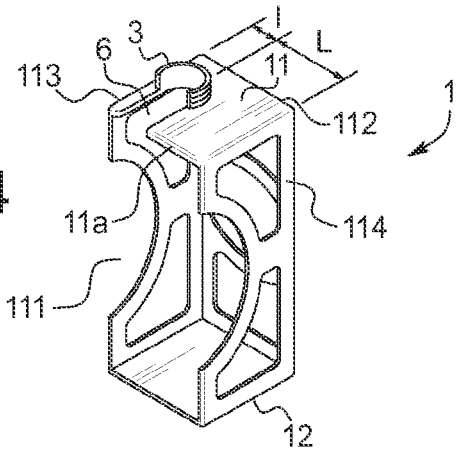
FIG. 4 shows a view of the dispensing support according to the second embodiment.

FIG. 4 illustrates a dispensing support 1 according to the second embodiment of the invention. It comprises a sleeve having at least five contiguous walls including at least three side walls 112, 113, 114, a bottom wall 12 and a top wall 11, these walls defining an internal parallepiped volume. The last wall of the parallepiped 111 is opened. The side walls 112, 113, 114 are configured to extend along the length of a brick-type package side panels inserted inside. The sleeve top wall 11 presents a slit 6 extending from the top wall edge 11*a* deprived of contiguous side wall 111. The slit 6 being off-centre on the sleeve top wall 11: so as to engage the pour spout at the gable top panel of the brick-type package when said package is introduced in the dispensing support with its gable top compressed. In FIG. 4 the slit 6 is positioned closer to the side panel 113 of the sleeve (by the distance 1) rather than to the side panel 114 of the sleeve (by the distance L). The internal end of the slit comprises a part of an upwardly projecting spout 3. This spout is preferably threaded externally.

Figure 5:
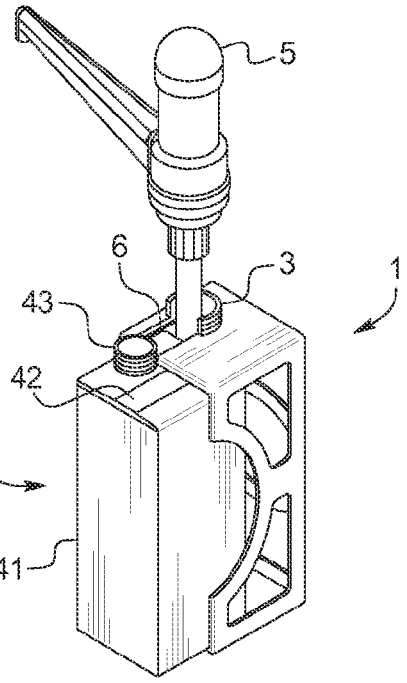
FIG. 5 shows how a package is introduced in the dispensing support of FIG. 4.
Figure 6:
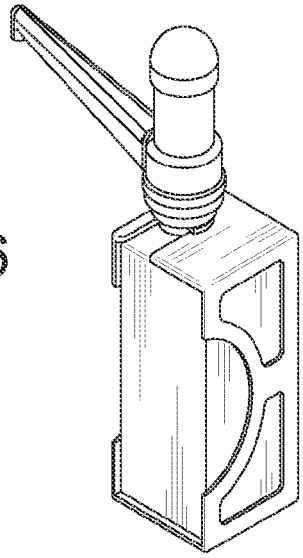
FIG. 6 shows a view of the dispensing support of FIG. 4 associated to a package.

As illustrated in FIG. 5 a package 4 can be inserted inside the dispensing support 1 by applying a compression on the gable top panel 42 so as to fold it until it is the top panel 42 is flat. Then the package 42 is introduced in the sleeve while maintaining the top folded and the package pour spout 43 fits inside the slit 6. The package 4 is slid until the part of the upwardly projecting spout 3 of the dispensing support 1 cooperates with the package pour spout 43. A manual pumping dispenser 5 can be introduced in the pour spout 43 of the package and can be engaged with the part of the upwardly projecting spout 3 of the dispensing support. FIG. 6 illustrates the assembly of the dispensing support 1, the package 4 and the dispenser 5, said assembly being ready to be operated for dispensing doses a liquid stored in the package in a convenient manner.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A dispensing support for use with an associated package, presenting a parallelepiped shape for its bottom and side panels and a gable top panel with a pour spout attached thereto, the dispensing support comprising:

the dispensing support comprises a parallelepiped sleeve, the sleeve being divided in two parts attached together by a hinge, so that the sleeve can be opened and the associated package can be inserted inside; and the dispensing support presents an upwardly projecting spout extending from a top wall of the parallelepiped sleeve, the spout being off-center on the top wall of the sleeve so as to engage the pour spout at the gable top panel of the package when the package is introduced in the dispensing support with its gable top compressed.

2. The dispensing support of claim 1, wherein the sleeve hinge is placed at one of a vertical side corner of the sleeve.

3. The dispensing support of claim 1, wherein the sleeve comprises a locking element at the edges of its two parts.

4. The dispensing support of claim 1, wherein each of the two parts of the sleeve comprises a part of the upwardly projecting spout.

5. The dispensing support of claim 1, wherein the upwardly projecting spout is configured for engaging a dispenser.

6. The dispensing support of claim 1, wherein the end of the slit comprises a part of an upwardly projecting spout configured for cooperating with the pour spout at the gable top panel of the package.

* * * * *